United States Patent [19]

Tyrer et al.

[11] 4,384,603

[45] May 24, 1983

[54] INFLATABLE RECEPTACLE

[75] Inventors: Richard G. Tyrer, Liverpool; James R. France, Newport, both of England

[73] Assignee: Balfour Beatty Limited, Surrey, England

[21] Appl. No.: 229,148

[22] Filed: Jan. 28, 1981

[30] Foreign Application Priority Data

Jan. 28, 1980 [GB] United Kingdom ..... 8002813

[51] Int. Cl.[3] ..... B65D 88/16

[52] U.S. Cl. ..... 150/0.5; 150/52 R; 206/522

[58] Field of Search ..... 150/0.5, 52 R; 206/522

[56] References Cited

U.S. PATENT DOCUMENTS 3,337,418 8/1967 Halacy ..... 150/0.5
3,937,389 2/1976 Wind ..... 150/0.5
3,965,953 6/1976 Becker et al. ..... 150/0.5 X
4,044,867 8/1977 Fisher ..... 150/0.5 X

*Primary Examiner*—Donald F. Norton
*Attorney, Agent, or Firm*—Buell, Blenko, Ziesenheim & Beck

[57] ABSTRACT

An inexpensive, readily handled receptacle for use in the bulk impregnation of timber by vacuum impregnation is made of flexible fluid-impermeable material and, over parts of its walls, is of double thickness to form closed pockets that can be inflated to form a container of rectangular shape hinged along one of its side faces to provide a sealable opening for loading and unloading. The pockets have a valve for inflating them with air; the receptacle has inlet and outlet ports for evacuating the receptacle and introducing impregnant. Preferably, the receptacle is supported in a two-part rectangular frame hinged along one side face.

16 Claims, 2 Drawing Figures

INFLATABLE RECEPTACLE

In the Complete Specification of our co-pending cognate British patent application Nos. 709/77 and 47987/77 (Ser. No. 1589781) there is described and claimed an improved method of impregnating with an impregnant in a liquid or semi-liquid state a body or bodies made wholly or in part of organic fluid-permeable material, which method comprises introducing said body or a plurality of said bodies into a receptacle of flexible fluid-impermeable material through an opening therein, the flexible receptacle being supported by and secured to a substantially rigid structure in such a way that the receptacle is held open for the introduction through said opening of said body or plurality of bodies; sealing the opening in the receptacle to form a substantially fluid-tight enclosure; evacuating air and any other fluid from within the fluid-tight enclosure so formed and from voids in the or each body housed therein to cause the flexible, fluid-impermeable material of the receptacle to collapse around the body or bodies; and allowing impregnant in a liquid or semi-liquid state to enter the fluid tight enclosure and to flow through and impregnate the organic fluid-permeable material of the or each body.

In the Complete Specification of our co-pending British patent application No. 929/78 (Ser. No. 1589782) there is described and claimed a flexible receptacle for use in the impregnation with an impregnant in a liquid or semi-liquid state of a body or bodies made wholly or in part of organic fluid-permeable material, which receptacle is made of flexible fluid-impermeable material and has an opening for introduction into the receptacle of said body or bodies, re-usable means for sealing said opening to form a substantially fluid tight flexible enclosure, at least one outlet with an associated valve through which air and any other fluid can be evacuated from the receptacle and, separate from the outlet or outlets, at least one inlet with an associated valve through which impregnant in a liquid or semi-liquid state can be introduced into the receptacle. In a preferred embodiment, the receptacle is in the form of a preformed container of substantially rectangular shape.

It is an object of the present invention to provide an improved receptacle for use in the impregnation with an impregnant in a liquid or semi-liquid state, by the method claimed in the aforesaid cognate British patent applications, of a body or bodies made wholly or in part of organic fluid-permeable material.

According to the invention, the improved receptacle is made of a flexible fluid-impermeable material which, over at least a part or parts of a wall or walls of the receptacle, is of double thickness and forms a closed pocket or pockets which can be inflated by fluid impregnation, the pocket or pockets being so positioned that when the or each pocket is inflated the receptacle is in the form of a container of substantially rectangular shape effectively hinged along at least one of its side faces to provide an opening for introduction into the receptacle of said body or bodies, and the receptacle has means for sealing said opening to form a substantially fluid-tight flexible enclosure, at least one port with an associated valve opening into the pocket or pockets through which fluid can be introduced to inflate said pocket or pockets, and at least one port with an associated valve opening into the receptacle through which air and any other fluid can be evacuated from the receptacle and through which impregnant in a liquid or semi-liquid state can be introduced into the receptacle.

Preferably, the receptacle has at least two ports each with an associated valve opening into it, at least one port and its associated valve constituting an outlet through which air and any other fluid can be evacuated from the receptacle and, separate from the outlet or outlets, at least one port and its associated valve constituting an inlet through which impregnant in a liquid or semi-liquid state can be introduced into the receptacle.

In one preferred embodiment of the invention, pockets formed by a double thickness of flexible fluid-impermeable material extend along each of the boundary edges of the receptacle to form, in effect, inflatable ribs joined by flexible fluid-impermeable material of single thickness forming the side and end faces of the receptacle. The inflatable rib extending along one boundary edge of one end face of the receptacle and the inflatable rib extending along the corresponding boundary edge of the other end face are each sub-divided by an intermediate non-inflatable portion which is substantially more flexible than the inflatable ribs joined to it and effectively constitutes one end of a hinge extending along one side face of the receptacle. The opposite side face and the end faces of the receptacle are divided into two separate parts which are joined at the hinge and which can be moved apart to provide said opening of the receptacle or can be moved together to close said opening by pivotal movement of one part relative to the other about the pivotal axis of said hinge. The boundary edges of said two parts of the receptacle which abut when the receptacle is closed preferably have outwardly extending flanges which abut, one or each of the flanges having a layer of cellular plastics material or other readily compressible material applied to it to effect a fluid-tight seal. Preferably, separately formed means is provided for releasably clamping the two flanges together in the closed position. Such clipping means may comprise a plurality of resilient clips or screw threaded clamps.

In one alternative embodiment, substantially the whole of the walls of the receptacle are of flexible fluid-impermeable material of double thickness and may be divided into two or more pockets into which air or other fluid can be injected to inflate the walls and form a receptacle of substantially rectangular form. As in the previous embodiment, the receptacle is hinged along one side face, e.g. between two longitudinally extending pockets, the opposite side face and the end faces being divided into two parts joined at the hinge.

In all cases, preferably the pockets are all interconnected so that all of the pockets can be inflated by injection of air or other fluid through a single port.

Preferably, in use, the receptacle is supported by and secured to a substantially rigid structure, e.g. a lattice framework, built up of two parts which are hinged together along an axis extending lengthwise of the structure. At least one counter-weight may be provided on one part of the structure so that, when the structure and receptacle supported therein are in the open position, the counter-weight or counter-weights hold them in the open position to facilitate loading or unloading of the receptacle. Preferably, one part of the structure has an opening of substantially the same cross-sectional shape as one part of the inflated receptacle so that the said part of the receptacle can be suspended in said part of the structure with its outwardly extending flange resting on the boundary edge of the opening in the structure and the other part of the structure surrounds the other part of the receptacle and rests on the outwardly extending flange of, and is supported by, the other part of the inflated receptacle.

The valves associated with the inlets and outlets of the receptacle preferably are non-return valves.

Preferably, the inlet(s) and outlet(s) are so positioned in the receptacle that, when the receptacle is in use, the or each inlet is at or near the bottom of the receptacle and the or each outlet is at or near the top of the receptacle. Preferably, also, the receptacle has at or near its lowermost part at least one drainage port with an associated valve for drainage of excess impregnant from the receptacle.

The receptacle may be formed wholly or in part of a transparent material so that progress of the impregnation process can be observed. Receptacles made from flexible transparent polyethylene sheet are expecially suitable; other suitable flexible materials include butyl rubber sheet.

The invention is further illustrated by a description, by way of example, of a preferred receptacle and associated supporting structure for use in the impregnation with an impregnant in a liquid or semi-liquid state of a body or bodies made wholly or in part of organic fluid-permeable material, with reference to the accompanying drawings in which.

Figure 1:
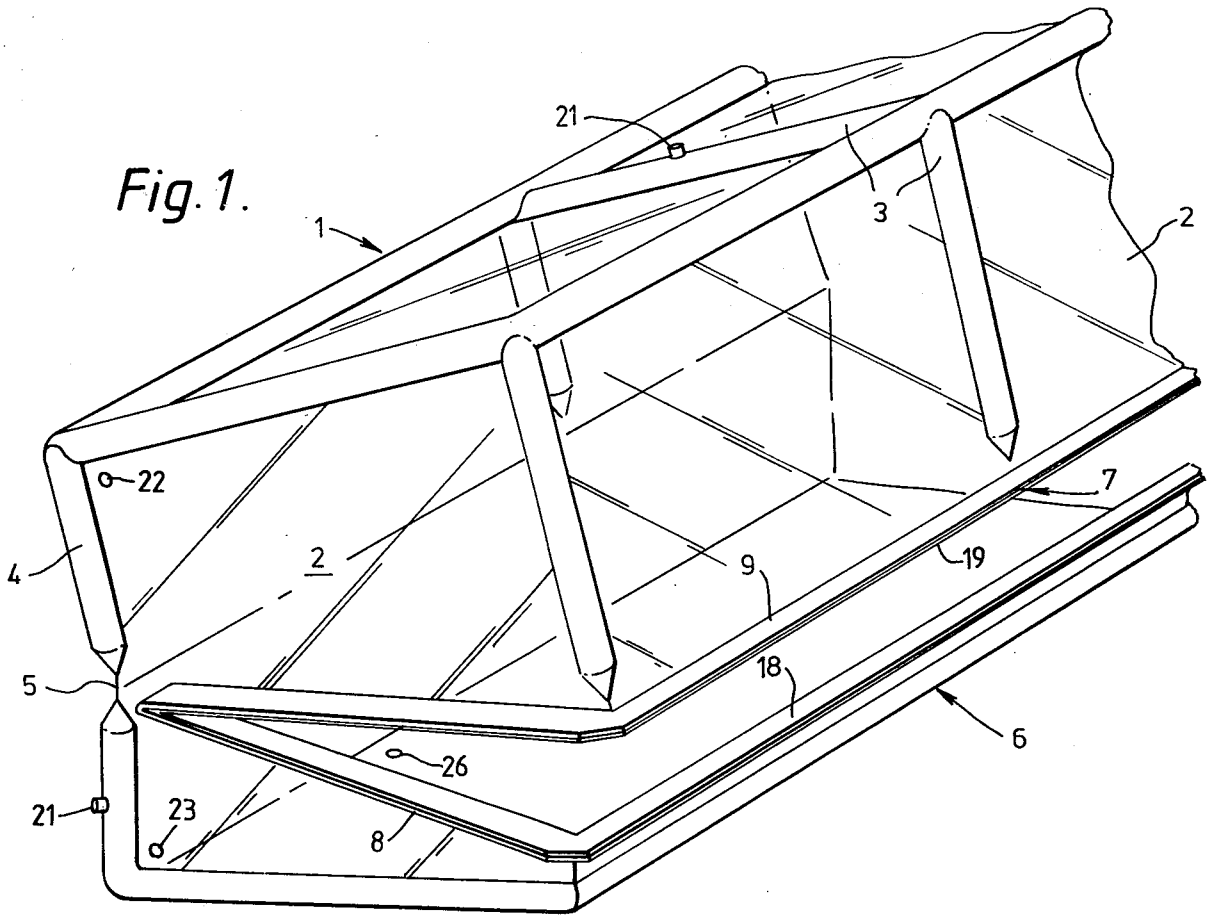
FIG. 1 is a fragmental isometric view of the receptacle.

Referring to FIG. 1, the receptacle is made of flexible butyl rubber sheet which, over parts of the receptacle extending along the boundary edges of the receptacle, is of double thickness to form pockets 1 which, in effect constitute inflatable ribs joined by flexible polyethylene material 2 of single thickness forming the side and end faces of the receptacle. Strengthening ribs 3 extend substantially parallel to the ribs 1 at the ends of the receptacle and are interconnected to the other ribs of the receptacle. The inflatable rib 4 extending along one boundary edge of one end face of the receptacle and the inflatable rib 4 extending along the corresponding boundary edge of the other end face are each subdivided by an intermediate non-inflatable portion 5 which is substantially more flexible than the inflatable ribs joined to it and effectively constitutes one end of a hinge extending along one side face of the receptacle. The opposite side face and the end faces of the receptacle are divided into two separate parts 6 and 7 which are joined at the hinge 5. The boundary edge of the part 6 has an outwardly extending flange 8; carrying a layer 18 of cellular plastics material and the boundary edge of the part 7 has an outwardly extending flange 9 carrying a layer 19 of cellular plastics material. A port 21 with an associated valve opens into one of the ribs 1 of each part 6 and 7 through which air can be introduced to inflate the ribs. An outlet port 22 with an associated valve opens into the receptacle near the top of the receptacle through which air and any other fluid can be evacuated from the receptacle, and separate from the outlet port, an inlet port 23 with an associated valve opens into the receptacle near the bottom of the receptacle through which impregnant in a liquid or semi-liquid state can be introduced into the receptacle.

Figure 2:
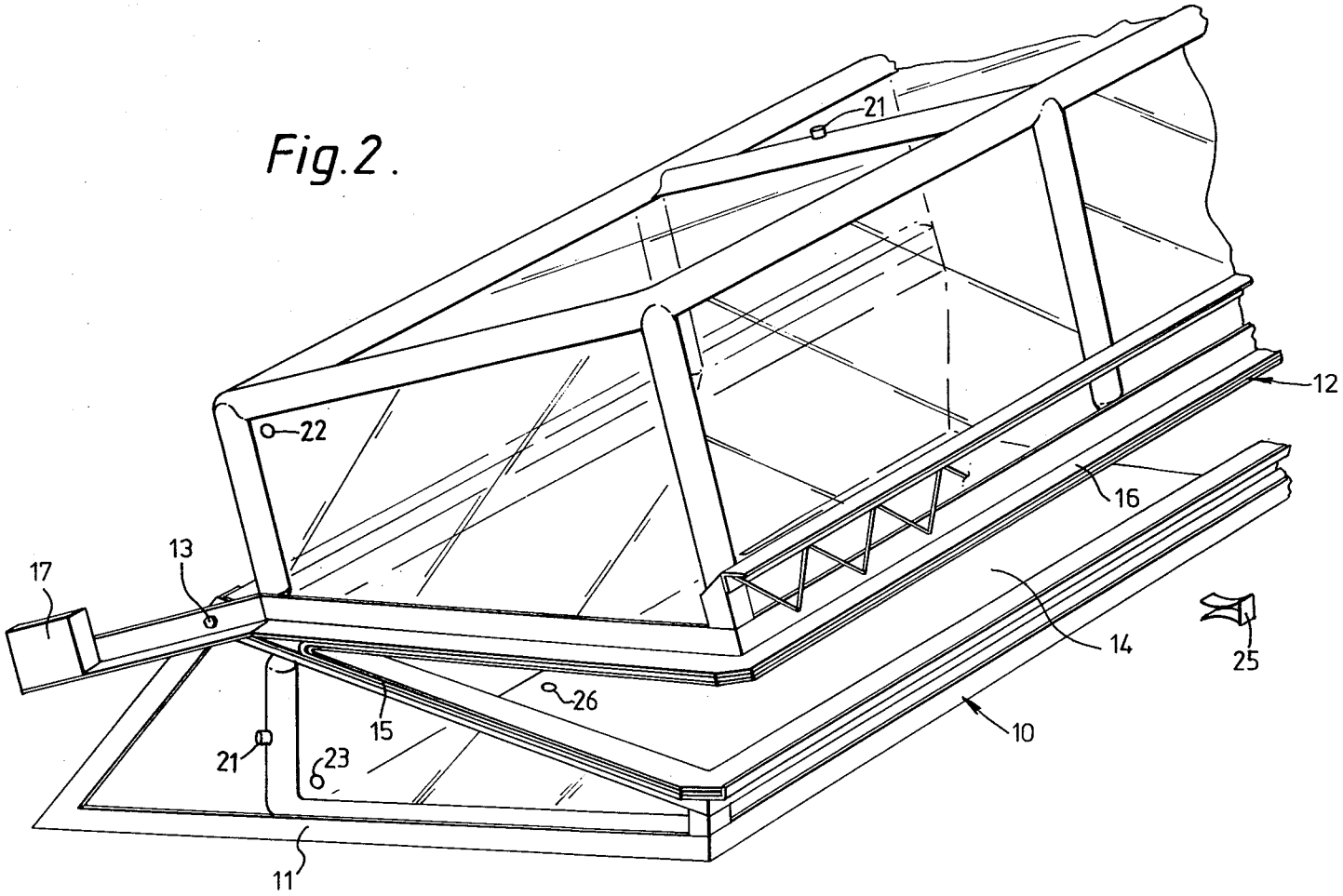
FIG. 2 is a fragmental isometric view of the receptacle mounted in its supporting structure.

The support structure 10 shown in FIG. 2 comprises a base support 11 and a lid 12, each in the form of a lattice framework which are hinged together about a pivotal axis 13. The base support 11 has an opening 14 of substantially rectangular shape which is bounded by an outwardly extending flange 15. The lid 12 has an opening of similar shape which is bounded by an outwardly extending flange 16. The lid 12 also has a counterweight 17 secured to its rear edge. When the receptacle is mounted in the support structure 10, the lower part 6 of the receptacle is supported in the base support 11 with its outwardly extending flange 8 resting on the flange 15 and the upper part 7 of the receptacle supports the lid 12, the flange 16 of the lid resting on the flange 9 of the upper part 7 of the receptacle. As will be seen, when the support structure 10 is pivoted about the axis 13 to open the receptacle, the counter-weight 17 holds a receptacle in the open position for loading or unloading of the bodies to be impregnated.

In use, the receptacle is positioned in the support structure 10 as illustrated in FIG. 2 and the pockets 1 including the ribs 3, 4 are inflated to form a container of substantially rectangular shape hinged along one side face. The support structure 10 is then pivoted about the pivotal axis 13 to open the lid 12 supported by the part 7 of the container, the container being held in the open position by the counter-weight 17. The container is loaded with the bodies to be impregnated and is then closed, the outwardly extending flanges 8 and 9 being sealed together by resilient clips 25, of which one only is shown to render the container fluid-tight. The pockets 1 including the ribs 3, 4 are then deflated, air is evacuated from within the container through the outlet port 22 and, when the container has been substantially evacuated and the receptacle has collapsed about the bodies contained in it, an impregnant in a liquid or semi-liquid state is introduced into the evacuated receptacle through the inlet port 23. On completion of the impregnation step surplus impregnant is drained from the receptacle through a drainage port 26, air is allowed to re-enter the container and the pockets 1 including ribs 3, 4 are again inflated to return the container to its substantially rectangular shape. The resilient clips 25 can then be removed, the container opened and the impregnated bodies unloaded.

What we claim as our invention is:

1. A receptacle for use in the impregnation with an impregnant in a liquid or semi-liquid state of at least one body made at least in part of organic fluid-permeable material, which receptacle is made of a flexible fluid-impermeable material which, over at least a part of at least one wall of the receptacle, is of double thickness and forms at least two closed pockets which can be inflated by fluid impregnation, the pockets being so positioned that when the pockets are inflated, the receptacle is in the form of a container of substantially rectangular shape and has side and end faces bounded by boundary edges, which receptacle is effectively hinged along at least one of its side faces to divide the receptacle into two separable parts and so provide an opening for introduction into the receptacle of said body at least one of said two separable parts carrying around that one of its boundary edges that will abut a boundary edge of the other separable part when the container is closed, material for sealing said opening to form a substantially fluid-tight flexible enclosure, at least one port with an associated valve opening into the pocket through which fluid can be introduced to inflate said pocket and at least one port with an associated valve opening into the receptacle through which air and any other fluid can be evacuated from the receptacle and through which impregnant in a liquid or semi-liquid state can be introduced into the receptacle.

2. A receptacle as claimed in claim 1, wherein the receptacle has at least two ports each with an associated valve opening into it, at least one port and its associated valve constituting an outlet through which air and any other fluid can be evacuated from the receptacle and, separate from the outlet, at least one port and its associated valve constituting an inlet through which impregnant in a liquid or semi-liquid state can be introduced into the receptacle.

3. A receptacle as claimed in claim 2, wherein the inlet and the outlet are so positioned in the receptacle that, when the receptacle is in use, the inlet is near the bottom of the receptacle and the outlet is near the top of the receptacle.

4. A receptacle as claimed in claim 1, wherein pockets formed by a double thickness of flexible fluid-impermeable material extend along at least some of said boundary edges of the receptacle to form, in effect, inflatable ribs joined by flexible fluid-impermeable material of single thickness forming the side and end faces of the receptacle.

5. A receptacle as claimed in claim 4, wherein the inflatable rib extending along one boundary edge of one end face of the receptacle and the inflatable rib extending along the corresponding boundary edge of the other end face are each sub-divided by an intermediate non-inflatable portion which is substantially more flexible than the inflatable ribs joined to it and which effectively constitutes one end of a hinge extending along one side face of the receptacle.

6. A receptacle as claimed in claim 5, wherein the opposite side face and the end faces of the receptacle are divided into said two separate parts which are joined at the hinge and which can be moved apart to provide said opening of the receptacle and can be moved together to close said opening by pivotal movement of one part relative to the other about the pivotal axis of said hinge.

7. A receptacle as claimed in claim 6, wherein the boundary edges of said two parts of the receptacle which abut when the receptacle is closed have outwardly extending flanges which abut, at least one of the flanges having a layer of readily compressible material applied to it to effect a fluid-tight seal.

8. A receptacle as claimed in claim 7, wherein separately formed means is provided for releasably clamping the two flanges together in the closed position.

9. A receptacle as claimed in claim 1, wherein substantially the whole of the walls of the receptacle are of flexible fluid-impermeable material of double thickness.

10. A receptacle as cliamed in claim 1, wherein the side face of the receptacle opposite to the hinged side face and the end faces are each divided into two parts joined at the hinge.

11. A receptacle as claimed in claim 1, which receptacle is supported by and secured to a substantially rigid structure.

12. A receptacle as claimed in claim 11, wherein the substantially rigid structure is a lattice framework built up of two parts which are hinged together along an axis extending lengthwise of the structure.

13. A receptacle as claimed in claim 12, wherein at least one counterweight is provided on one part of the structure so that, when the structure and receptacle supported therein are in the open position, the counterweight holds them in the open position to facilitate loading or unloading of the receptacle.

14. A receptacle as claimed in claim 12 or 13, wherein one part of the structure has an opening bounded by a boundary edge and of substantially the same cross-sectional shape as one part of the inflated receptacle so that the said part of the inflated receptacle can be suspended in said part of the structure with an outwardly extending flange on said part of the receptacle resting on the boundary edge of the opening in the structure, and the other part of the structure surrounds the other part of the inflated receptacle and rests on an outwardly extending flange of, and is supported by, the other part of the inflated receptacle.

15. A receptacle as claimed in claim 1, which receptacle has near its lowermost part at least one drainage port with an associated valve for drainage of excess impregnant from the receptacle.

16. A receptacle as claimed in claim 1, which receptacle is formed at least in part of a transparent material.

* * * * *